US007802691B2

(12) United States Patent
Mušálek

(10) Patent No.: US 7,802,691 B2
(45) Date of Patent: Sep. 28, 2010

(54) PLASTIC COLLAPSIBLE BOTTLE WITH ACCORDION-LIKE ARRANGED BELLOWS RIDGES

(76) Inventor: Oto Mušálek, Vrablovec 1306/99 747 14 Ludge#ovice, okr., Opava (CZ)

( * ) Notice: Subject to any disclaimer, the term of this patent is extended or adjusted under 35 U.S.C. 154(b) by 0 days.

(21) Appl. No.: 10/582,851

(22) PCT Filed: Dec. 2, 2004

(86) PCT No.: PCT/CZ2004/000081

§ 371 (c)(1),
(2), (4) Date: Jun. 14, 2006

(87) PCT Pub. No.: WO2005/061336

PCT Pub. Date: Jul. 7, 2005

(65) Prior Publication Data

US 2007/0145000 A1 Jun. 28, 2007

(30) Foreign Application Priority Data

Dec. 22, 2003 (CZ) ..... PV 2003-3538

(51) Int. Cl.
*B65D 90/02* (2006.01)

(52) U.S. Cl. ..... 215/381; 215/900; 215/382; 215/11.3; 220/666; 220/671; 220/674

(58) Field of Classification Search ..... 215/900, 215/381, 11.3, 382; 220/907, 666, 674, 671
See application file for complete search history.

(56) References Cited

U.S. PATENT DOCUMENTS 3,301,293 A * 1/1967 Santelli ..... 220/666
3,335,902 A * 8/1967 Javorik ..... 220/673
3,353,700 A * 11/1967 Kalina ..... 220/667
3,918,603 A * 11/1975 Hatada ..... 220/667
4,095,728 A * 6/1978 Chlystun ..... 222/529
4,158,376 A * 6/1979 Erb ..... 383/120
4,790,361 A * 12/1988 Jones et al. ..... 220/666
4,865,211 A * 9/1989 Hollingsworth ..... 220/8
5,002,193 A * 3/1991 Touzani ..... 215/396
5,174,458 A * 12/1992 Segati ..... 215/383
5,174,469 A * 12/1992 Policapelli ..... 220/710
5,201,438 A * 4/1993 Norwood ..... 220/666
5,310,068 A * 5/1994 Saghri ..... 215/386
5,573,129 A * 11/1996 Nagata et al. ..... 215/382
5,584,413 A * 12/1996 Jung ..... 220/666
5,662,684 A * 9/1997 Caso ..... 606/234

(Continued)

FOREIGN PATENT DOCUMENTS

EP 0 850 842 7/1998

*Primary Examiner*—Anthony Stashick
*Assistant Examiner*—Christopher B McKinley
(74) *Attorney, Agent, or Firm*—Richard H. Tushin; Dykema Gossett PLLC

(57) ABSTRACT

The bottle has accordion-like collapsible bellows ridges (1) with upper and lower arched shape surfaces (1',1"), always only one of the surfaces (1',1") is provided with a system of ridge embossed or stamped stiffenings (2) without horizontal continuity. System of vertical stamped stiffenings (3) is present as well, creating recesses (4) of the bellows ridges (1) with angle greater than 90°, having arched shape haunches (5) at the top and bottom. Stacking depression (6) is created in the bottom of the bottle, the bottle is preferably provided with removable label leaving no residue and it has completely detachable cap (7).

8 Claims, 6 Drawing Sheets

U.S. PATENT DOCUMENTS

| | | | | | |
|---|---|---|---|---|---|
| 5,746,339 | A | * | 5/1998 | Petre et al. | 215/383 |
| 5,758,789 | A | * | 6/1998 | Shin et al. | 215/382 |
| 5,762,230 | A | * | 6/1998 | Policappelli | 220/62.12 |
| 5,927,499 | A | * | 7/1999 | Vesborg | 206/509 |
| 6,105,815 | A | * | 8/2000 | Mazda | 220/666 |
| 6,112,925 | A | * | 9/2000 | Nahill et al. | 215/382 |
| 6,311,861 | B1 | * | 11/2001 | Policappelli | 220/669 |
| 6,598,755 | B1 | | 7/2003 | Pedulla et al. | |
| 6,669,040 | B2 | * | 12/2003 | Higuchi | 215/381 |
| RE38,770 | E | * | 8/2005 | Gilbert | 215/382 |
| D510,035 | S | * | 9/2005 | Higuchi | D9/683 |
| 6,938,788 | B2 | * | 9/2005 | White | 215/384 |
| 7,108,151 | B2 | * | 9/2006 | Higuchi | 220/666 |
| 7,172,087 | B1 | * | 2/2007 | Axe et al. | 215/382 |
| D586,224 | S | * | 2/2009 | Darr et al. | D9/538 |
| 2003/0015491 | A1 | * | 1/2003 | Melrose et al. | 215/381 |

* cited by examiner

PLASTIC COLLAPSIBLE BOTTLE WITH ACCORDION-LIKE ARRANGED BELLOWS RIDGES

TECHNICAL FIELD

The technical solution relates to a plastic collapsible bottle with accordion-like arranged bellows ridges, it relates particularly to the beverage PET bottles.

BACKGROUND ART

Plastic bottles, beverage PET bottles in particular, represent problematic waste. They pose a problem from the point of view of storage and disposal after use as well as from the point of view of possible separation and recycling. If these bottles are stored and put into waste after use without pressing, their large volume causes problems in storage, decreases economy of waste collection as well as economical efficiency of eventual disposal or recycling.

Because of aforementioned reasons, the patent documentation describes the effort to create easily collapsible or foldable plastic bottle made of PET or similar plastics; however, none of these solutions has been successful enough so that such collapsible bottles could be created for common market.

So far, the existing attempts to create collapsible bottles led only to creation of a possibility to fold the bottle after use; however, these bottles cannot be used for carbonated beverages.

For instance, WO 00/44630 describes a no-return bottle with gradually collapsing design of the side walls without a possibility of return to the original shape, the side walls having an accordion-like construction with a system of neighbouring folds. Each of these folds is created of two opposite surfaces of different width, and at least the smaller of the two surfaces is in the shape of arc. If such shape would be considered in relation to character of such created bellows ridges rather than to the folds, the condition of different width of the surfaces means that one half of each bellows ridge is of higher height or convexity than the second half. From this, the possibility of folding the bottle by light pressure is inferred. In practice, however, such bottle is even easily liable to spontaneous deformation, when the bottle shape deformation takes place particularly in the width direction due to the beverage weight, manipulation and storage; and also, such bottle is not suitable at all for carbonated beverages because it does not withstand the pressure acting from the interior on the bottle walls.

Another collapsible bottle has been described for instance in the EP 0 850 842 A 1 wherein a collapsible bottle is composed of accordion-like bellows ridges, whose upper walls or lower walls are provided with at least one circumferential groove. In these bottles, the groove creates reinforcement to increase their resistance against unwanted deformation and facilitates intentional folding of the bottle. In this case, however, the all-circumferential stamped stiffening, which is here to create a groove, results in impairment of dimensional symmetry between the upper and lower halves of the accordion-like bellows ridges of the bottle, which finally results in unwanted spontaneous deformations of bottles and impossibility of their filling with carbonated beverages.

Both aforementioned documents quote as the known state of the art the possibility to create accordion-like bottle with symmetrical bellows ridges, where the upper half of the bellows ridges is of the same shape and dimensions as the lower one, however, even this solution is useless in practice because of deformations.

DISCLOSURE OF INVENTION

The above-mentioned disadvantages are eliminated to a considerable extent by the invention. Final solution of plastic collapsible bottle with accordion-like arranged bellows ridges is provided that has walls created at least in its part as an accordion-like arranged structure containing system of adjoining horizontally running bellows ridges, each of which is created from two opposite surfaces, where both upper and lower surfaces of at least some bellows ridges are of arcuated shape, convexity of which is faced against the adjacent surface. The essence of the invention is that one of two surfaces on at least one bellows ridge is provided with a system of ridge embossed or stamped stiffenings, continuity of which is interrupted in horizontal direction. These embossed or stamped stiffenings on bellows ridges, thus ridge embossed or stamped stiffenings, apply always to only one half of the bellows ridge, upper or lower.

The system of ridge embossed or stamped stiffenings is created from two or more ridge embossed or stamped stiffenings, which are preferably arranged in a radial way on the bottle.

Optimal number of ridge embossed or stamped stiffenings is six to twenty and all of them are located on the same half of bellows ridges in the framework of the whole bottle, i.e. either all of them are on the upper half of the bellows ridges or all of them are on the lower half of the bellows ridges.

In addition to the ridge embossed or stamped stiffenings, the bottle is preferably provided also with a system of vertical stamped stiffenings that are running across the whole area of its accordion-like bellows ridges and are creating recesses of the bellows ridges on the bottle, which are so deep that they are reaching at least to the level of smaller circumferential diameter of the bellows ridges.

The system of vertical stamped stiffenings contains at least two vertical stamped stiffenings.

Vertical stamped stiffenings are situated preferably symmetrically on the bottle and the walls of recesses created by them in the bellows ridges form preferably an angle $\alpha$ greater than 90°.

Optimal number of vertical stamped stiffenings is two to eight, depending on dimensions and thickness of the bottle, but mainly depending on the bottle diameter. Optimum number of vertical stamped stiffenings for a common beverage bottle is three.

If possible, all said vertical stamped stiffenings are created preferably with smooth round transitions without sharp edges. An arched shape haunch of vertical stamped stiffening is created preferably in the direction to the neck as well as to the bottom of the bottle. The arched shape stands for an adjustment of the line of the vertical stamped stiffening nonforcedly to the shape of the bottle, namely creation of its beginning and end in the vicinity of the neck and bottom respectively as near as on the rounded upper and lower part of the bottle, it does not mean curvature of the line to the side for instance.

A stacking depression is preferably created in the bottom of the bottle, which projects inward to the bottle hollow in the shape of dimple to fit the cap of the neighbouring bottle during stacking.

Bellows ridges of the bottle as well as its bottom are preferably undisturbed by different material, such as glued-on label, self-adhesive price tag, etc., where the whole bottle is from homogenous material without presence of foreign matters fixed in a non-detachable way. The invention is solved completely even from this point of view, where the bottle is preferably labelled with removable label leaving no residue and a completely detachable cap is used for closing the bottle, thus allowing recycling without demanding removal of foreign matter.

The invention is utilizable for plastic bottles, beverage PET bottles in particular. The technical solution achieved possibility of safe and easy accordion-like folding of the bottle to the minimum volume as well as dimensional stability. The invention allows filling with common liquids as well as carbonated beverages without resulting in undesirable warping of the structure of the bottle. Possibility of stacked storage of collapsed as well as non-collapsed bottles is solved completely, including the possibility of efficient waste separation and recycling. If the bottle is labelled with removable label and also fitted with completely detachable cap, removal of ballast matter and secondary processing of pure material can be achieved quickly and easily. Collapsible bottles will make possible decreasing of waste volume, increasing of the waste disposal efficiency as well as making secondary processing more effective. Consequently, environmental benefit of decreasing occurrence of these materials in landfills can be expected.

BRIEF DESCRIPTION OF DRAWINGS

The invention is illustrated using drawings, where.

EXAMPLE OF EMBODIMENT OF THE INVENTION

Figure 1:
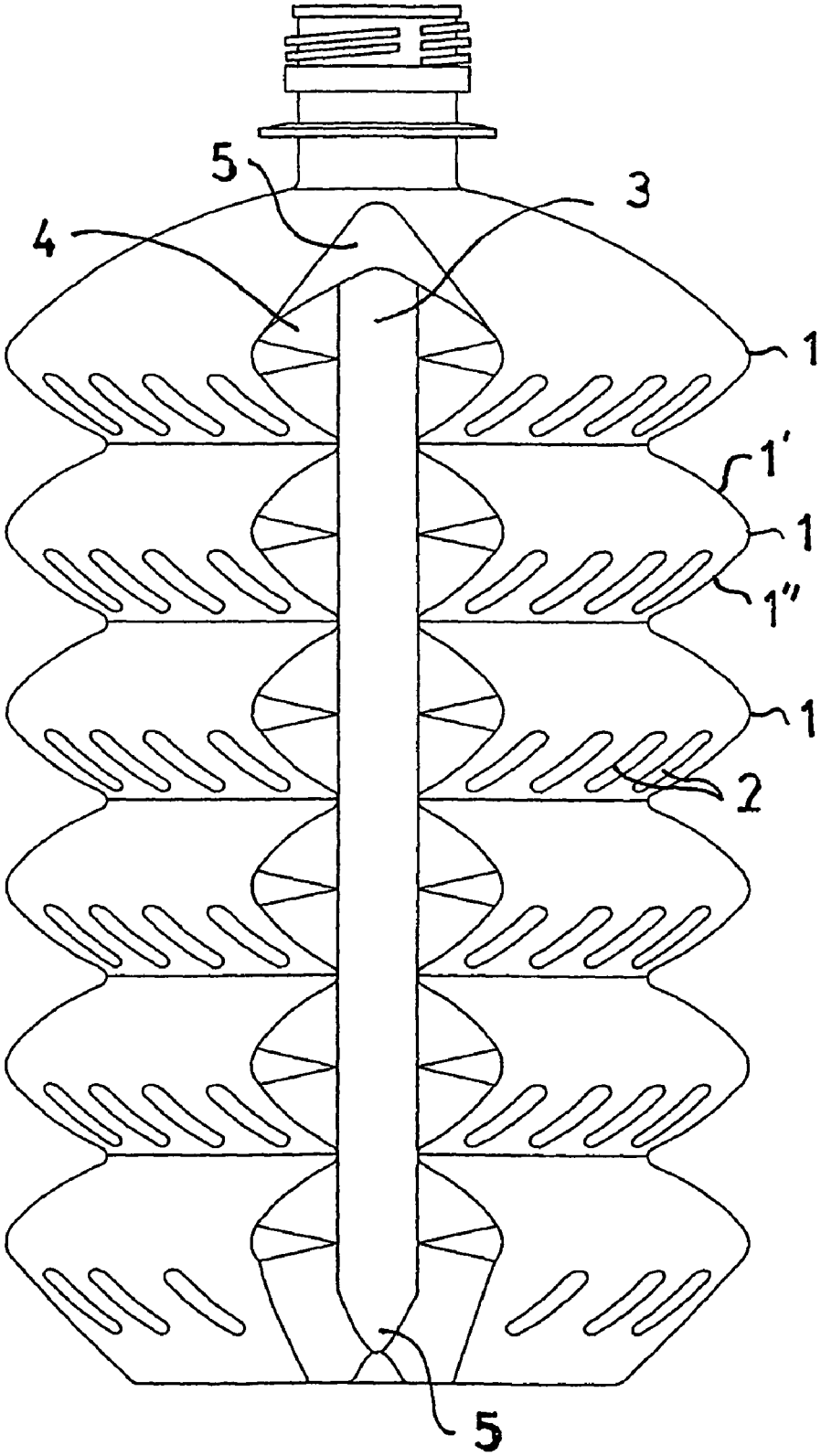
FIG. 1 shows optimal example of the bottle according to the invention.
Figure 2:
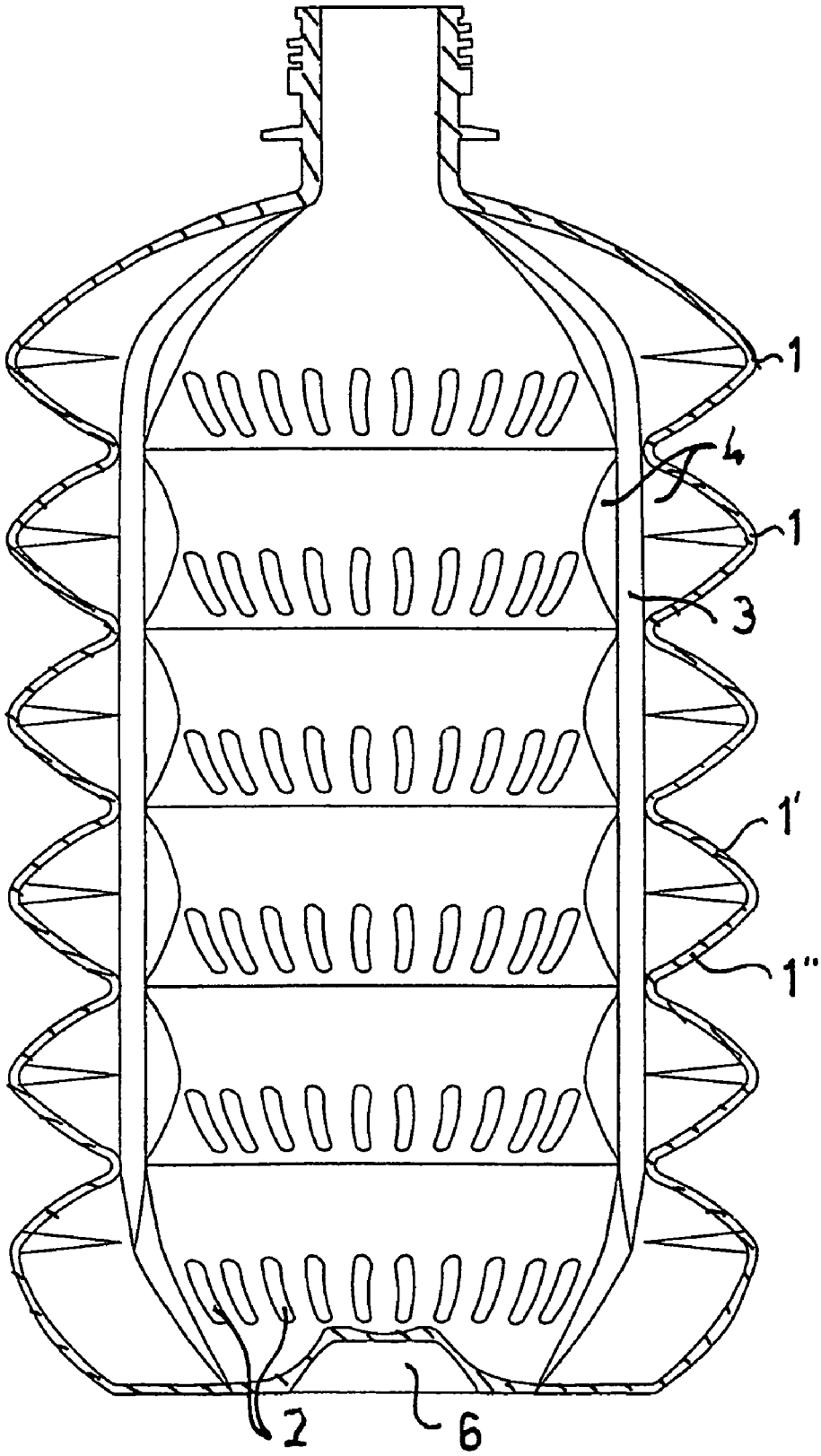
FIG. 2 shows sectional view of the bottle.
Figure 3:
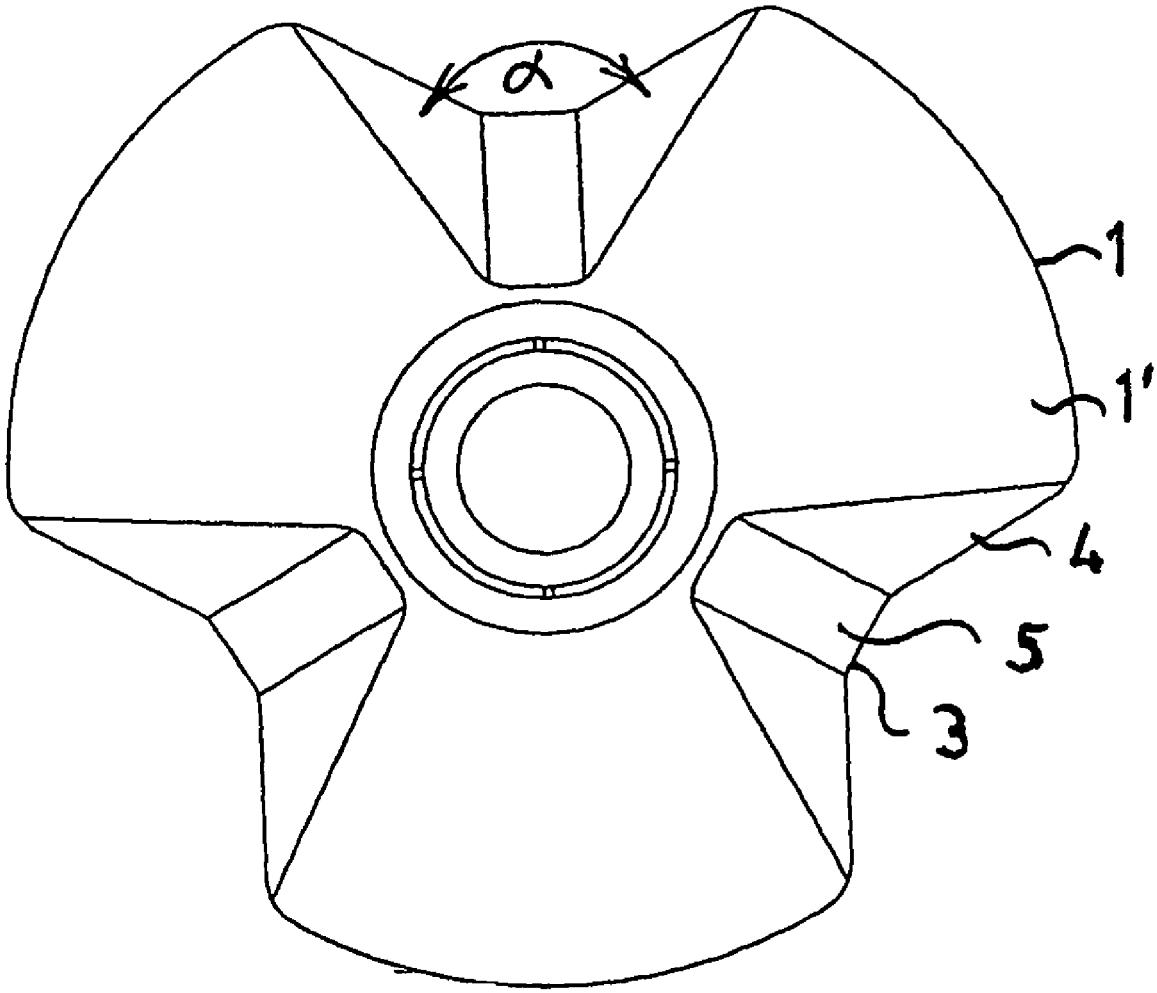
FIG. 3 shows top view of the same bottle.
Figure 4:
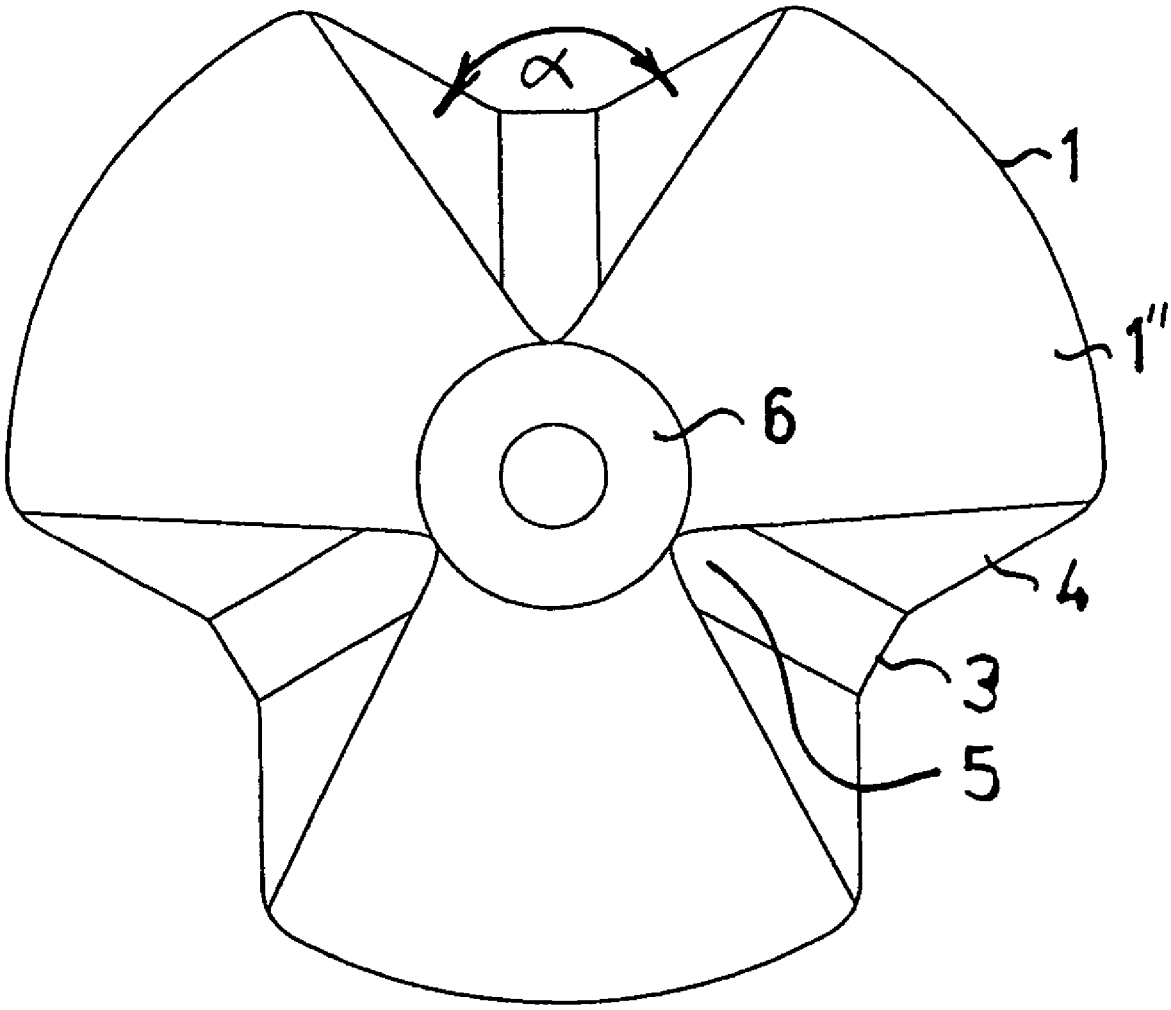
FIG. 4 shows bottom view of the same bottle.

Example of embodiment of the invention in the optimum arrangement is the collapsible beverage PET bottle according to FIGS. 1 to 4.

The collapsible bottle has walls created as an accordion-like arranged structure containing system of adjoining horizontally running bellows ridges 1, each of which is created from two opposite surfaces 1', 1". Except the uppermost and the bottom bellows ridges, all bellows ridges 1 have their both surfaces 1, 1", the upper and the lower one, mutually symmetrical and of arched shape, convexity of which is faced against the adjacent surface 1', 1". Each lower surface 1" of each bellows ridge 1 is provided with a system of ridge embossed or stamped stiffenings 2, continuity of which is interrupted in horizontal direction. This means that they are not created as continuous circumferential grooves, etc., so that the basic shape of the bellows ridges 1 is not affected by them. However, difference in strength of the upper surface 1' compared to the lower surface 1" is created, which manifests essentially in the moment of folding. Ridge embossed or stamped stiffenings 2 are named according to their appearance on the bellows ridges 1. If the ridge embossed or stamped stiffenings 2 are created on the lower surface 1" of bellows ridges 1, the bottle will collapse in a dished shape, if they are created on the upper surface 1', the bottle will collapse in a shape crowned in the opposite direction.

In addition to the ridge embossed or stamped stiffening 2, the bottle is provided also with three vertical stamped stiffenings 3 in the shape of vertical strips that are running across the whole area of its accordion-like bellows ridges 1 and are creating recesses 4 of the bellows ridges 1 on the bottle. Strips of vertical stamped stiffenings 3 are running approximately on the level of circumferential circle of joints between bellows ridges 1, so that the recess 4 is reaching, and in the deepest place may be even overhanging, the depth of the level of the smaller circumferential diameter of bellows ridges 1. Vertical stamped stiffenings 3 are situated symmetrically on the bottle and the walls of recesses 4 created by them in the bellows ridges 1 form advantageous open angle $\alpha$ approximately 120°, i.e. preferably greater than 90°. All vertical stamped stiffenings 3 are having smooth rounded shape transitions without sharp edges. Thus the shapes presented on figures do not represent sharp edges, these are just for clarification of the shape scheme.

Arched shape haunches 5 of vertical stamped stiffenings 3 are created in the direction to the neck as well as to the bottom of the bottle. Bottom of the bottle is preferably in its central part cambered up from the horizontal plane in an arch like way. In this way, a stacking depression 6 is created, which projects inward to the bottle hollow in the shape of dimple to fit the cap or neck of the neighbouring bottle during stacking.

Figure 5:
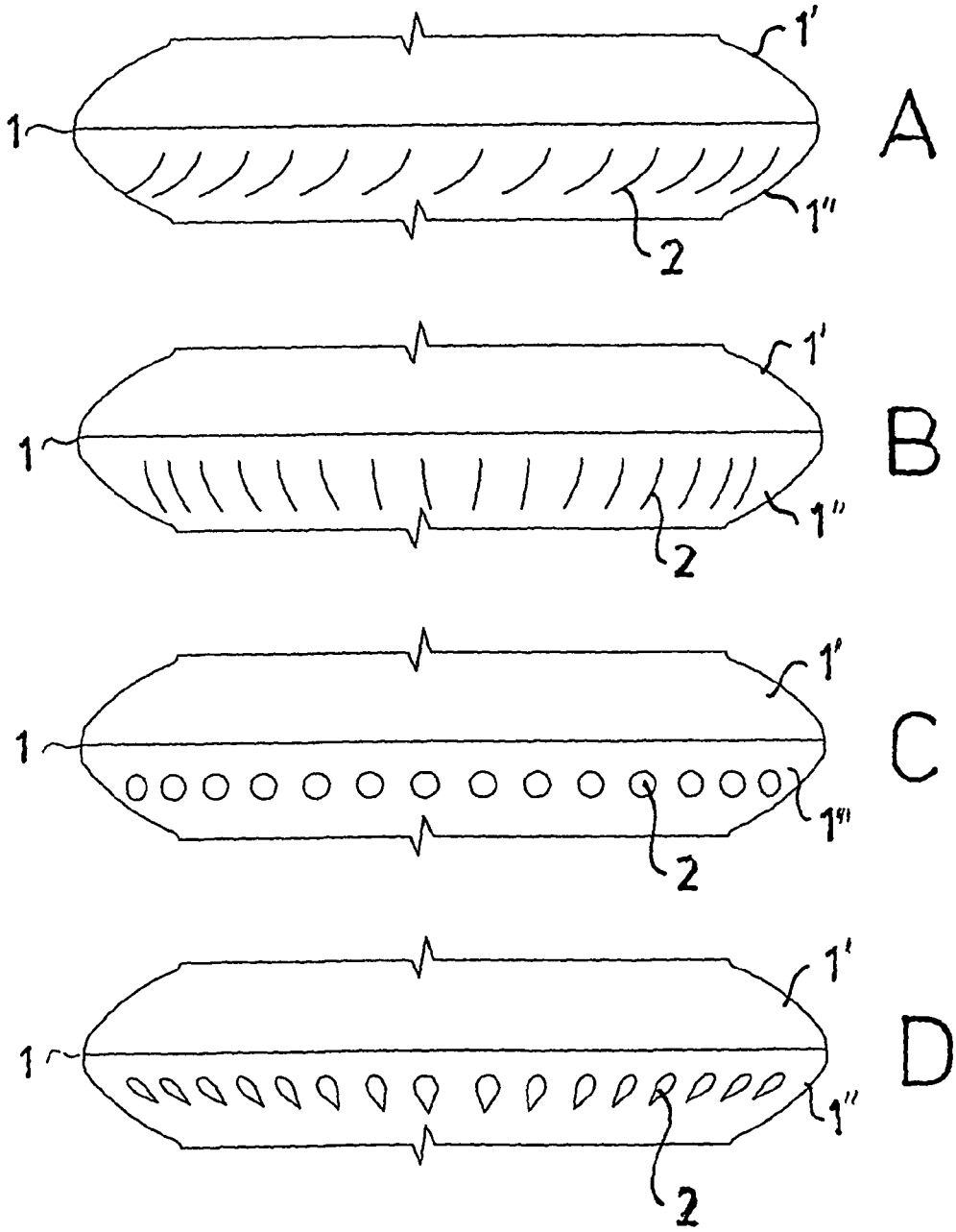
FIGS. 5 A through D shows different shaping variants of accordion-like bellows ridges according to the invention.

Descriptive examples of the bellows ridges 1 embodiment options according to the invention, not limiting possibilities of other implementations, are demonstrated on FIG. 5. Case A describes a system of arched, radial ridge embossed or stamped stiffenings 2, case B describes radial shape, case C describes circular shape, and case D describes a shape of drop-shaped radial rays. The figure also demonstrates possibility of the bellows ridges 1 without vertical stamped stiffenings 3.

Figure 6:
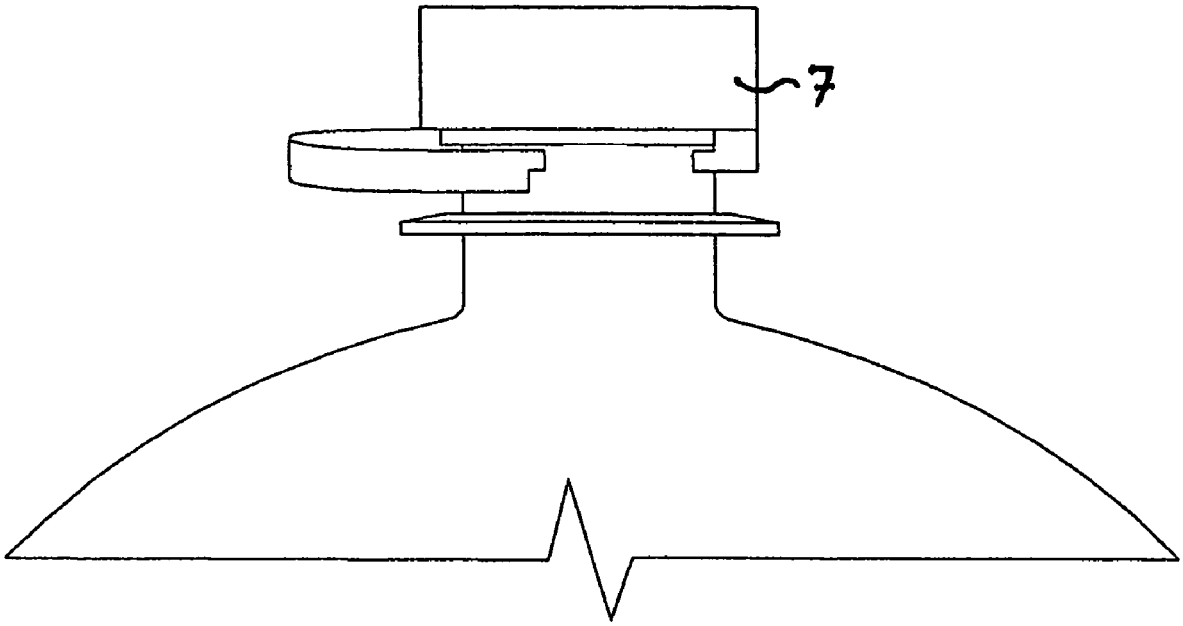
FIG. 6 shows completely detachable bottle cap according to the invention.

Completely detachable cap 7 allowing recycling is suitable for closing the bottle according to the invention and is illustrated on FIG. 6.

The invention claimed is:

1. A plastic collapsible bottle with accordion-like arranged bellows ridges that has walls created at least in its part as an accordion-like arranged structure containing system of adjoining horizontally running bellows ridges, each of which is created from two opposite surfaces, where both upper and lower surfaces of at least some bellows ridges are of arched shape, convexity of which is faced against the adjacent surface, wherein only the one of two surfaces on at least one bellows ridge, and merely always on the upper surfaces or on the lower surfaces are provided with a plurality of spaced, ridge embossed or stamped stiffenings, the ridge embossed or stamped stiffenings arranged in horizontal direction on the upper surfaces or the lower surfaces, the ridge embossed or stamped stiffenings creating a difference in strength of the upper surfaces compared to the lower surfaces, wherein a continuity of the horizontally arranged bellows ridges and the ridge embossed or stamped stiffenings are interrupted in horizontal direction by the system of vertical stamped stiffenings, containing at least two vertical stamped stiffenings, wherein the system of vertical stamped stiffenings runs across the whole area of the accordion-like bellows ridges, wherein the vertical stamped stiffenings create recesses of the bellows ridges on the bottle, reaching at least to the level of smaller circumferential diameter of the bellows ridges, the walls of the recesses created in the bellows ridges form an angle $\alpha$ greater than 90°, the vertical stamped stiffenings having smooth rounded transitions without sharp edges, wherein an arched shape haunch of the vertical stamped stiffening is created in the direction of a neck and a bottom of the bottle.

2. The plastic collapsible bottle with accordion-like arranged bellows ridges according to claim 1, wherein the system of ridge embossed or stamped stiffenings is created from at least two ridge embossed or stamped stiffenings, which are radial.

3. The plastic collapsible bottle with accordion-like arranged bellows ridges according to claim 1, wherein the ridge embossed or stamped stiffenings are in the number of six to twenty and all of them are located on the same half of bellows ridges in the framework of the whole bottle.

4. The plastic collapsible bottle with accordion-like arranged bellows ridges according to claim 1, wherein the number of vertical stamped stiffenings is two to eight, preferably three on a common beverage bottle.

5. A plastic collapsible bottle with accordion-like arranged bellows ridges that has walls created at least in its part as an accordion-like arranged structure containing system of adjoining horizontally running bellows ridges, each of which is created from two opposite surfaces, where both upper and lower surfaces of at least some bellows ridges are of arched shape, convexity of which is faced against the adjacent surface, wherein only the one of two surfaces on at least one bellows ridge, and merely always on the upper surfaces or on the lower surfaces are provided with a plurality of separate ridge embossed or stamped stiffenings, the ridge embossed or stamped stiffenings arranged in horizontal direction on the upper surfaces or the lower surfaces, the ridge embossed or stamped stiffenings creating a difference in strength of the upper surfaces compared to the lower surfaces, wherein a continuity of the horizontally arranged bellows ridges and the ridge embossed or stamped stiffenings are interrupted in horizontal direction by the system of vertical stamped stiffenings, containing at least two vertical stamped stiffenings situated symmetrically on the bottle, wherein the system of vertical stamped stiffenings runs across the whole area of the accordion-like bellows ridges, wherein the vertical stamped stiffenings create recesses of the bellows ridges on the bottle, reaching at least to the level of smaller circumferential diameter of the bellows ridges, the walls of the recesses created in the bellows ridges form an angle $\alpha$ greater than 90°, the vertical stamped stiffenings having smooth rounded transitions without sharp edges, wherein an arched shape haunch of the vertical stamped stiffening is created in the direction of a neck and a bottom of the bottle.

6. The plastic collapsible bottle with accordion-like arranged bellows ridges according to claim 5, wherein the system of ridge embossed or stamped stiffenings is created from at least two ridge embossed or stamped stiffenings, which are radial.

7. The plastic collapsible bottle with accordion-like arranged bellows ridges according to claim 5, wherein the ridge embossed or stamped stiffenings are in the number of six to twenty and all of them are located on the same half of bellows ridges in the framework of the whole bottle.

8. The plastic collapsible bottle with accordion-like arranged bellows ridges according to claim 5, wherein the number of vertical stamped stiffenings is two to eight, preferably three on a common beverage bottle.

* * * * *